US007432889B2

(12) United States Patent
Yumoto

(10) Patent No.: US 7,432,889 B2
(45) Date of Patent: Oct. 7, 2008

(54) ACTIVE MATRIX TYPE DISPLAY APPARATUS, ACTIVE MATRIX TYPE ORGANIC ELECTROLUMINESCENCE DISPLAY APPARATUS, AND DRIVING METHODS THEREOF

(75) Inventor: Akira Yumoto, Kanagawa (JP)

(73) Assignee: Sony Corporation, Tokyo (JP)

( * ) Notice: Subject to any disclaimer, the term of this patent is extended or adjusted under 35 U.S.C. 154(b) by 0 days.

(21) Appl. No.: 10/154,262

(22) Filed: May 23, 2002

(65) Prior Publication Data

US 2002/0196211 A1 Dec. 26, 2002

(30) Foreign Application Priority Data

May 25, 2001 (JP) ..... P2001-156509

(51) Int. Cl.
*G09G 3/30* (2006.01)
*H05B 37/02* (2006.01)

(52) U.S. Cl. ..... 345/77; 345/76; 315/169.3

(58) Field of Classification Search ..... 345/76–84, 345/87–98

See application file for complete search history.

(56) References Cited

U.S. PATENT DOCUMENTS 5,886,475 A * 3/1999 Horiuchi et al. ..... 315/169.3
6,023,259 A * 2/2000 Howard et al. ..... 345/76
6,809,710 B2 * 10/2004 Prache et al. ..... 345/82

FOREIGN PATENT DOCUMENTS

EP 1 061 497 A1 12/2000
JP 2001-42822 2/2001

* cited by examiner

*Primary Examiner*—Duc Q Dinh
(74) *Attorney, Agent, or Firm*—Sonnenschein Nath & Rosenthal LLP

(57) ABSTRACT

An active matrix type display apparatus of the present invention includes pixel circuits each having an electrooptic device that changes brightness thereof according to a current flowing therein and driving said electrooptic device on the basis of brightness data supplied via a data line, and a current type pixel driving circuit for supplying each of said pixel circuits with a writing current that temporally increases in magnitude of a current value thereof within a cycle of writing of said brightness data. In the matrix type display apparatus of the present invention, the magnitude of the current value of the writing current is temporally increased within the writing cycle, whereby the writing current is limited to a low level (or zero) in an early stage of the writing cycle. Thus, the average value of the writing current is reduced.

12 Claims, 8 Drawing Sheets

ACTIVE MATRIX TYPE DISPLAY APPARATUS, ACTIVE MATRIX TYPE ORGANIC ELECTROLUMINESCENCE DISPLAY APPARATUS, AND DRIVING METHODS THEREOF

RELATED APPLICATION DATA

The present application claims priority to Japanese Application(s) No(s). P2001-156509 filed May 25, 2001, which application(s) is/are incorporated herein by reference to the extent permitted by law.

BACKGROUND OF THE INVENTION

The present invention relates to an active matrix type display apparatus having an active device in each pixel and controlling display in the pixel unit by means of the active device and a driving method thereof, and particularly to an active matrix type display apparatus using an electrooptic device that varies brightness according to a current flowing therein, an active matrix type organic EL display apparatus using an organic-material electroluminescence (hereinafter described as organic EL (electroluminescence)) device as the electrooptic device, and driving methods thereof.

For example, a liquid crystal display using a liquid crystal cell as a display device of a pixel has a large number of pixels arranged in a matrix manner, and controls light intensity in each pixel according to information of an image to be displayed, to thereby effect driving for image display. The same display driving is effected by an organic EL display using an organic EL device as a display device of a pixel and the like.

Since the organic EL display is a so-called self-luminous type display using a light emitting device as the display device of a pixel, the organic EL display has advantages such as higher visibility of images, no need for a backlight, and a higher response speed as compared with the liquid crystal display. Moreover, the organic EL display differs greatly from the liquid crystal display or the like, which uses liquid crystal cells of a voltage-controlled type, in that brightness of each light emitting device is controlled by the value of a current flowing therein, that is, the organic EL device is of a current-controlled type.

As with the liquid crystal display, the organic EL display can use a passive matrix method and an active matrix method as its driving method. However, the former has a simple construction but has problems such as difficulty in realizing a large high-definition display. Thus, the active matrix method has recently been actively developed which controls a current flowing through a light emitting device within a pixel by means of an active device also disposed within the pixel, for example an insulated gate field-effect transistor (typically a thin film transistor (TFT)).

FIG. 1 shows a conventional example of a pixel circuit (circuit of a unit pixel) in an active matrix type organic EL display (For more detailed description, see U.S. Pat. No. 5,684,365 and Japanese Patent Laid-Open No. Hei 8-234683).

As is clear from FIG. 1, the pixel circuit according to the present conventional example includes: an organic EL device 101 having an anode (anode) connected to a positive power supply vdd; a TFT 102 having a drain connected to a cathode (cathode) of the organic EL device 101 and a source connected to a ground (hereinafter described as "grounded"); a capacitor 103 connected between a gate of the TFT 102 and the ground; and a TFT 104 having a drain connected to the gate of the TFT 102, a source connected to a data line 106, and a gate connected to a scanning line 105.

Since the organic EL device has a rectifying property in many cases, the organic EL device may be referred to as an OLED (Organic Light Emitting Diode). Therefore, in FIG. 1 and other figures, a symbol of a diode is used to denote the OLED. In the following description, however, a rectifying property is not necessarily required of the OLED.

The operation of the thus formed pixel circuit is as follows. First, when potential of the scanning line 105 is brought to a selected state (high level in this case) and a writing potential Vw is applied to the data line 106, the TFT 104 conducts, the capacitor 103 is charged or discharged, and thus a gate potential of the TFT 102 becomes the writing potential Vw. Next, when the potential of the scanning line 105 is brought to a non-selected state (low level in this case), the TFT 102 is electrically disconnected from the scanning line 105, while the gate potential of the TFT 102 is stably retained by the capacitor 103.

A current flowing through the TFT 102 and the OLED 101 assumes a value corresponding to a gate-to-source voltage Vgs of the TFT 102, and the OLED 101 continues emitting light at a brightness corresponding to the value of the current. The operation of selecting the scanning line 105 and transmitting to the inside of the pixel brightness data supplied to the data line 106 will hereinafter be referred to as "writing." As described above, after the pixel circuit shown in FIG. 1, once writing of the potential Vw is done, the OLED 101 continues emitting light at a fixed brightness until next writing.

An active matrix type display apparatus (organic EL display) can be formed by arranging a large number of such pixel circuits (which may hereinafter be described simply as pixels) 111 in a matrix manner as shown in FIG. 2, and repeating writing from a voltage driving type data line driving circuit (voltage driver) 114 through data lines 115-1 to 115-m while selecting scanning lines 112-1 to 112-n sequentially by a scanning line driving circuit 113. A pixel arrangement of m columns and n rows is shown in this case. Of course, in this case, the number of data lines is m and the number of scanning lines is n.

Each light emitting device in a passive matrix type display apparatus emits light only at an instant when the light emitting device is selected, whereas a light emitting device in an active matrix type display apparatus continues emitting light even after completion of writing. Thus, the active matrix type display apparatus is advantageous especially for use as a large high-definition display in that the active matrix type display apparatus can decrease peak brightness and peak current of the light emitting device as compared with the passive matrix type display apparatus.

In an active matrix type organic EL display, a TFT (thin film field-effect transistor) formed on a glass substrate is generally used as an active device. It is well known, however, that amorphous silicon and polysilicon used to form the TFT has inferior crystallinity and inferior controllability of the conducting mechanism to single-crystal silicon, and thus the formed TFT has great variations in characteristics.

When a polysilicon TFT is formed on a relatively large glass substrate, in particular, the polysilicon TFT is generally crystallized by a laser annealing method after formation of an amorphous silicon film, in order to avoid problems such as thermal deformation of the glass substrate. However, it is difficult to irradiate the large glass substrate with uniform laser energy, and thus the crystallized state of the polysilicon is inevitably varied depending on a location within the substrate. As a result, it is not rare that the threshold value Vth of even TFTs formed on the same substrate is varied from pixel to pixel by a few hundred mV, or 1 V or more in some cases.

In that case, even when the same potential Vw is written to different pixels, for example, the threshold value Vth of the TFTs varies from pixel to pixel. This results in great variation from pixel to pixel in the current Ids flowing through the OLED (organic EL device), and hence complete deviation of the current Ids from a desired value. Therefore high picture quality cannot be expected of the display. This is true for not only variation in the threshold value Vth but also variation in carrier mobility μ and the like.

In order to remedy such a problem, the present inventor has proposed a current writing type pixel circuit shown in FIG. 3 as an example (see International Publication Number WO01/06484).

As is clear from FIG. 3, the current writing type pixel circuit includes: an OLED 121 having an anode connected to a positive power supply Vdd; an N-channel TFT 122 having a drain connected to a cathode of the OLED 121 and a source grounded; a capacitor 123 connected between a gate of the TFT 122 and the ground; a P-channel TFT 124 having a drain connected to a data line 128, and a gate connected to a scanning line 127; an N-channel TFT 125 having a drain connected to a source of the TFT 124, and a source grounded; and a P-channel TFT 126 having a drain connected to the drain of the TFT 125, a source connected to the gate of the TFT 122, and a gate connected to the scanning line 127.

The thus formed pixel circuit is crucially different from the pixel circuit shown in FIG. 1 in the following respect: in the case of the pixel circuit shown in FIG. 1, brightness data is supplied to the pixel in the form of voltage, whereas in the case of the pixel circuit shown in FIG. 3, brightness data is supplied to the pixel in the form of current.

First, when brightness data is to be written, the scanning line 127 is brought to a selected state (low level in this case), and a current Iw corresponding to the brightness data is passed through the data line 128 The current Iw flows through the TFT 124 to the TFT 125. In this case, let Vgs be a gate-to-source voltage occurring in the TFT 125. Because of a short circuit between the gate and drain of the TFT 125, the TFT 125 operates in a saturation region.

Thus, according to a well-known equation of a MOS transistor, the following holds:

$$Iw=\mu 1Cox1W1/L1/2(Vgs-Vth1)^2 \quad (1)$$

In the equation (1), Vth1 is the threshold value of the TFT 125; μl is carrier mobility; Cox1 is gate capacitance per unit area; W1 is channel width; and L1 is channel length.

Then, letting Idrv be a current flowing through the OLED 121, the current value of the current Idrv is controlled by the TFT 122 connected in series with the OLED 121 In the pixel circuit shown in FIG. 3, a gate-to-source voltage of the TFT 122 coincides with the Vgs in the equation (1), and hence, assuming that the TFT 122 operates in a saturation region, $$Idrv=\mu 2Cox2W2/L2/2(Vgs-Vth2)^2 \quad (2)$$

Incidentally, a condition for operation of a MOS transistor in a saturation region is generally known to be:

$$|Vds|>|Vgs-Vt| \quad (3)$$

The meanings of the parameters in the equation (2) and the equation (3) are the same as in the equation (1). Since the TFT 125 and the TFT 122 are formed adjacent to each other within a small pixel, it may be considered that actually μ1=μ2, Cox1=Cox2, and Vth1=Vth2. Then, the following is readily derived from the equation (1) and the equation (2):

$$Idrv/Iw=(W2/W1)/(L2/L1) \quad (4)$$

Specifically, even when the values themselves of the carrier mobility μ, the gate capacitance Cox per unit area, and the threshold value Vth vary within a panel surface or from panel to panel, the current Idrv flowing through the OLED 121 is in exact proportion to the writing current Iw, and consequently light emitting brightness of the OLED 121 can be controlled accurately. In particular, when a design is made such that W2=W1 and L2=L1, for example, Idrv/Iw=1, that is, the writing current Iw and the current Idrv flowing through the OLED 121 are of the same value irrespective of variations in the TFT characteristics.

FIG. 4 is a circuit diagram showing another circuit example of a current writing type pixel circuit. The pixel circuit according to the present circuit example is in opposite relation in terms of a transistor conduction type (N channel/P channel) from the pixel circuit according to the circuit example shown in FIG. 3. Specifically, the N-channel TFTs 122 and 125 in FIG. 3 are replaced with P-channel TFTs 132 and 135, and the P-channel TFTs 124 and 126 in FIG. 3 are replaced with N-channel TFTs 134 and 136. The direction of current flow and the like are also different. However, operating principles are exactly the same.

An active matrix type organic EL display apparatus can be formed by arranging the above-described current writing type pixel circuits as shown in FIG. 3 and FIG. 4 in a matrix manner. FIG. 5 shows an example of configuration of the active matrix type organic EL display apparatus.

In FIG. 5, scanning lines 142-1 to 142-n are arranged one for each of rows of current writing type pixel circuits 141 corresponding in number with m columns×n rows and disposed in a manner of the matrix. The gate of the TFT 124 in FIG. 3 (or the gate of the TFT 134 in FIG. 4) and the gate of the TFT 126 in FIG. 3 (or the gate of the TFT 136 in FIG. 1) are connected in each pixel to the scanning line 142-1 to 142-n. The scanning lines 142-1 to 142-n are sequentially driven by a scanning line driving circuit 143.

Data lines 144-1 to 144-m are arranged one for each of the columns of the pixel circuits 141. One end of each of the data lines 144-1 to 144-m is connected to an output terminal for each column of a current driving type data line driving circuit (current driver CS) 145. The data line driving circuit 145 writes brightness data to each of the pixels through the data lines 144-1 to 144-m.

When such a circuit to which brightness data is supplied in the form of a current value, that is, a current writing type pixel circuit as shown in FIG. 3 or FIG. 4 is used as a pixel circuit, power consumption in writing the brightness data tends to be increased. The reason is as follows: the voltage writing type pixel circuit shown in FIG. 1 and the active matrix type display apparatus using the voltage writing type pixel circuit do not consume direct current in driving a data line, whereas the current writing type pixel circuit and the active matrix type display apparatus using the current writing type pixel circuit consume direct current in driving a data line.

For example, when it is assumed that, as realistic numerical values, a maximum value of writing current per data line is 100 μA, a supply voltage is 15 V, and, supposing a full-color XGA (extended graphics array) panel, the number of data lines is 1024×3(RGB)=3072, power consumption required for writing is as high as 100 μA×3072×15 V=4.6 W. To be more specific, the power consumption is lower because the writing current does not flow during a vertical blanking period, but does not differ greatly.

For lower power consumption, it suffices to simply lower the value of the writing current; in that case, however, a problem of an increase in required writing time arises. Specifically, in the current writing method, the output impedance of the current driving circuit serving as a current source is substantially infinite, and therefore the impedance of the circuit is determined by a transistor within the pixel circuit or, more specifically, the TFT 125 in the example of the pixel circuit in FIG. 3.

More specifically, when both sides of the foregoing equation (1) of the MOS transistor are differentiated with respect to the gate-to-source voltage Vgs, $$1/Rpix=\mu 1Cox1W1/L1(Vgs-Vth1) \quad (5)$$

where Rpix is differential resistance of the TFT 125 as viewed from the data line 128. From the equation (1) and the equation (5), the following is obtained:

$$Rpix=1/\sqrt{(2\mu 1Cox1W1/L1\cdot Iw)} \quad (6)$$

As is clear from the equation (6), the differential resistance Rpix is in inverse proportion to the square root of the writing current Iw. On the other hand, a large parasitic capacitance Cdata is generally present in the data line 128. Thus, a time constant $\tau$ of the writing circuit around a steady state is substantially $$\tau=Cdata\times Rpix \quad (7)$$

In the current writing method, in order to stabilize the potential of the data line in a steady state, a sufficiently long writing time as compared with the time constant $\tau$ is desirable. As is clear from the equation (6) and the equation (7), however, the time constant $\tau$ becomes longer as the writing current is decreased, and since in writing black data, in particular, Iw=0, in theory, the writing is not completed within a finite time. In practice, since errors are tolerable to some extent, for example, it is possible to perform practical writing operation even within a finite writing time. However, the writing of a small current basically requires a longer writing time than the writing of a large current.

This presents a serious problem especially when low-brightness data, which means a low current value, is written, when the parasitic capacitance Cdata of the data line 128 is increased as a result of an increase in the size of the display, or in a high-definition display, in which an allowable writing time (scanning period) is shortened. The reason for its being a serious problem is that in order to complete writing operation within a predetermined period, the writing current needs to be increased, but this results in an increase in power consumption.

SUMMARY OF THE INVENTION

The present invention has been made in view of the above problems, and it is accordingly an object of the present invention to provide an active matrix type display apparatus, an active matrix type organic EL display apparatus, and driving methods thereof that reduce power consumption required for writing brightness data while maintaining sufficient writing performance, and thereby enable reduction in power consumption when a current writing type pixel circuit is used.

In order to achieve the above object, according to a first aspect of the present invention, there is provided an active matrix type display apparatus formed by arranging pixel circuits in a matrix manner, the pixel circuits each having an electrooptic device that changes brightness thereof according to a current flowing therein and driving the electrooptic device on the basis of brightness data supplied as current via a data line, wherein a writing current that temporally increases in magnitude of a current value thereof within a cycle of writing the brightness data is supplied to each of the pixel circuits via the data line.

In the thus formed active matrix type display apparatus or an active matrix type organic EL display apparatus using an organic EL device as the electrooptic device, the magnitude of the current value of the writing current is temporally increased within the writing cycle, whereby the writing current is limited to a low level (or zero) in an early stage of the writing cycle. Thus, the average value of the writing current is reduced.

DETAILED DESCRIPTION OF THE PREFERRED EMBODIMENTS

DETAILED DESCRIPTION OF THE PREFERRED EMBODIMENTS

Preferred embodiments of the present invention will hereinafter be described in detail with reference to the drawings.

Figure 6:
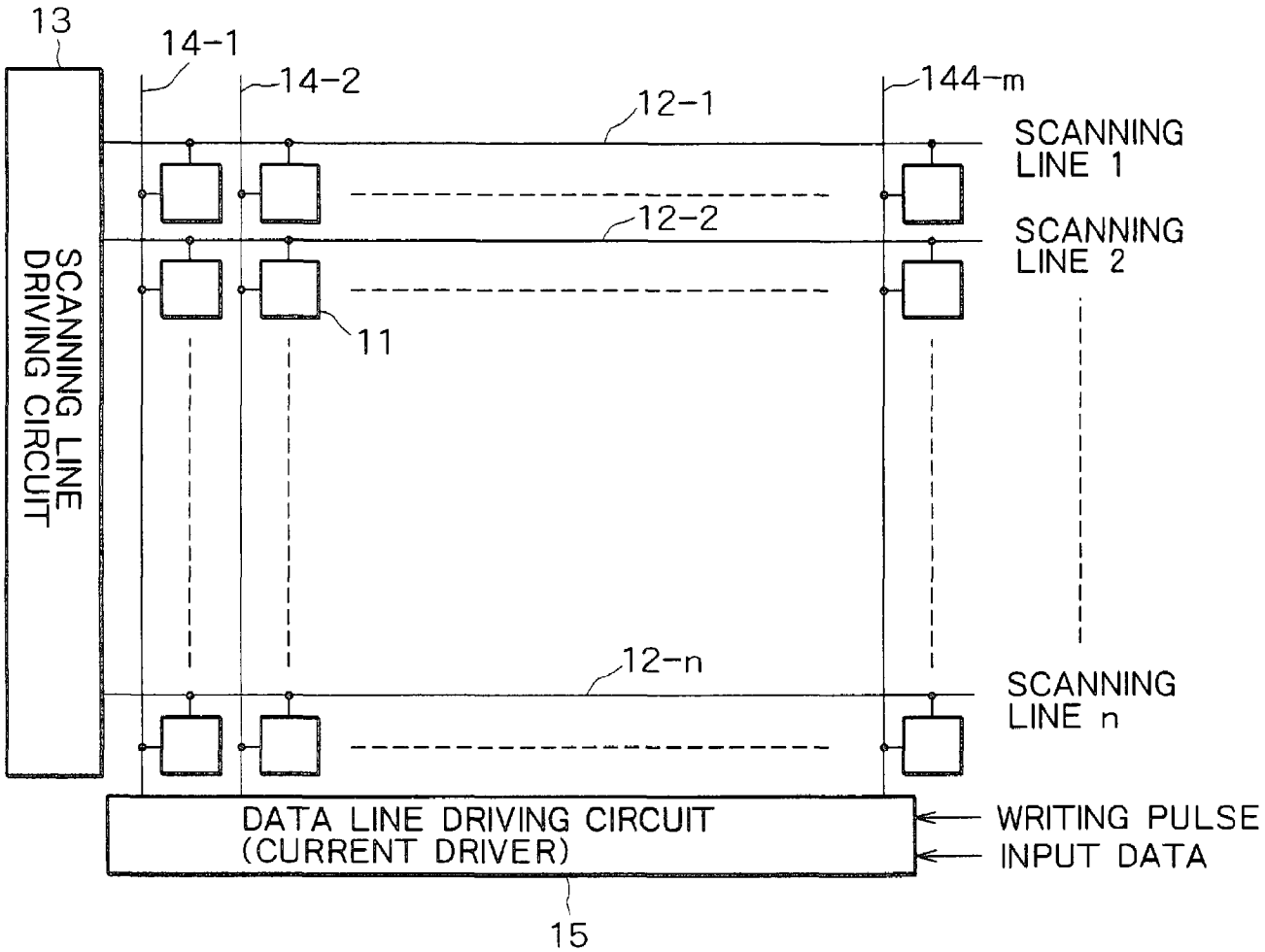
FIG. 6 is a schematic diagram of a configuration of an active matrix type display apparatus according to an embodiment of the present invention.

FIG. 6 is a schematic diagram of a configuration of an active matrix type display apparatus according to an embodiment of the present invention. Description in the following will be made by taking as an example a case where an organic EL device is used as an electrooptic device of each pixel, and a field-effect transistor, for example a polysilicon TFT is used as an active device of each pixel so that the present invention is applied to an active matrix type organic EL display apparatus obtained by forming the organic EL device on a substrate where the polysilicon TFT is formed.

Figure 1:
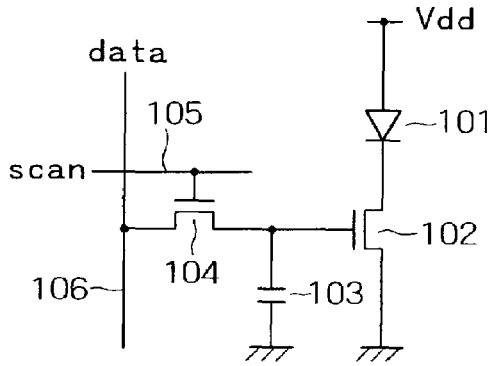
FIG. 1 shows a circuit configuration of a voltage writing type pixel circuit according to a conventional example.
Figure 2:
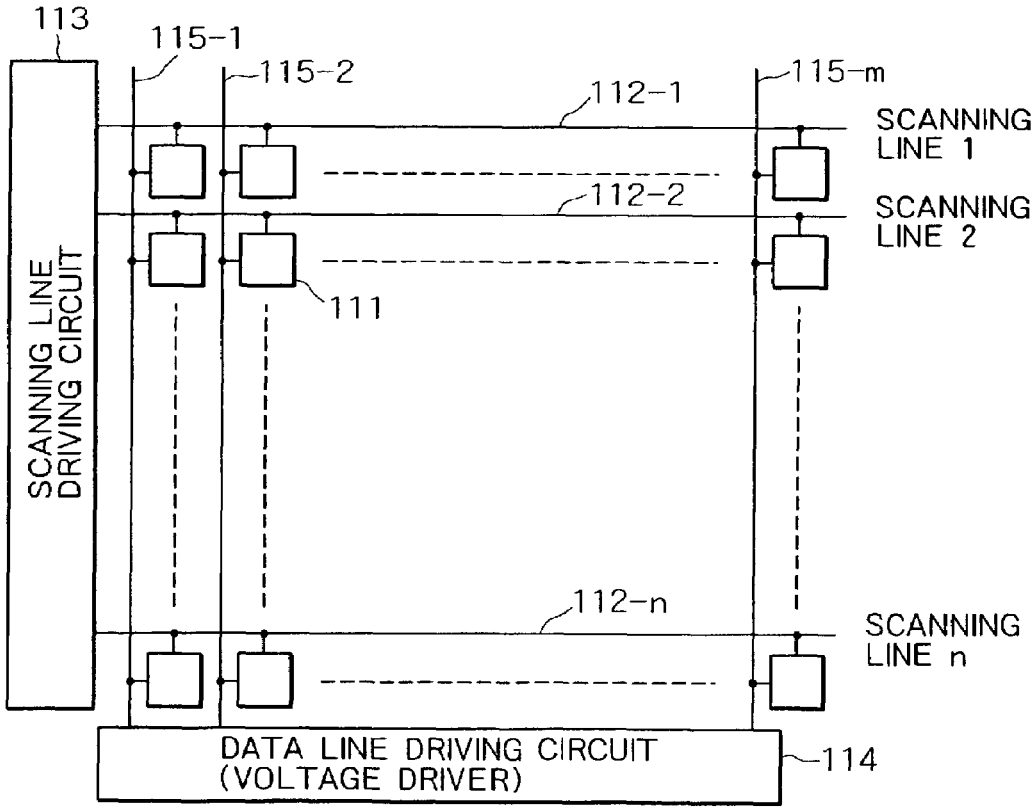
FIG. 2 is a block diagram showing an example of configuration of an active matrix type display apparatus using the voltage writing type pixel circuit according to the conventional example.
Figure 3:
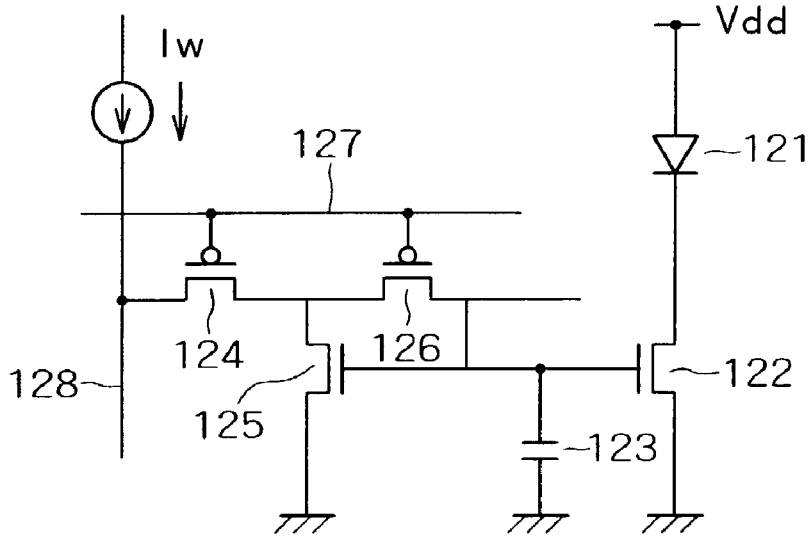
FIG. 3 shows a circuit configuration of a current writing type pixel circuit according to a first conventional example.
Figure 4:
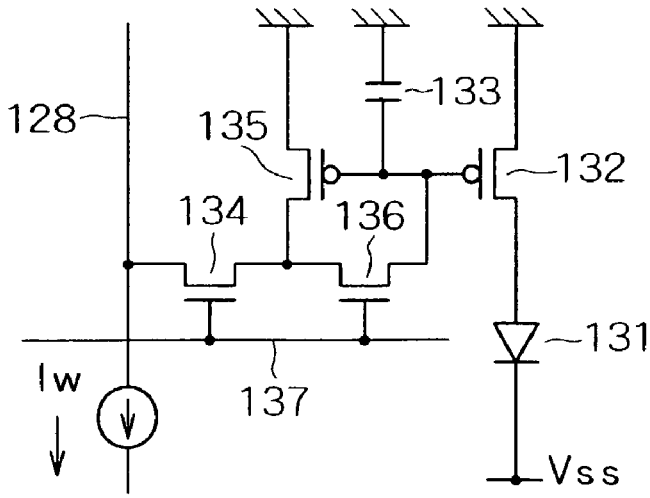
FIG. 4 shows a circuit configuration of a current writing type pixel circuit according to a second conventional example.
Figure 5:
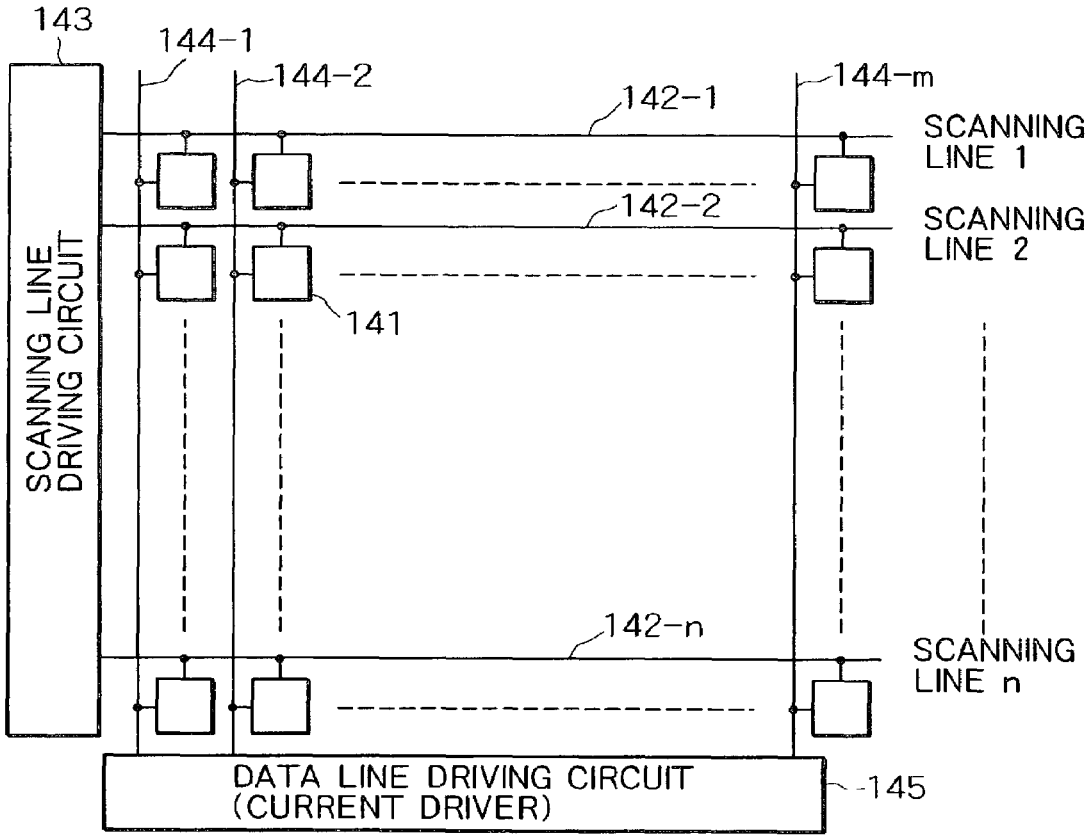
FIG. 5 is a block diagram showing an example of configuration of an active matrix type display apparatus using the current writing type pixel circuit according to the conventional example.

In FIG. 6, current writing type pixel circuits 11 corresponding in number with m columns×n rows are arranged in a matrix manner. A circuit of a circuit configuration shown in FIG. 3 or a circuit of a circuit configuration shown in FIG. 4, for example, is used as a current writing type pixel circuit 11. Scanning lines 12-1 to 12-n are arranged one for each of the rows of the pixel circuits 11. The scanning lines 12-1 to 12-n are sequentially driven by a scanning line driving circuit 13.

Data lines 14-1 to 14-m are arranged one for each of the columns of the pixel circuits 11. One end of each of the data lines 14-1 to 14-m is connected to an output terminal for each column of a current driving type data line driving circuit (hereinafter referred to as current driver) 15. The current driver 15 is supplied with input data in the form of voltage and a writing pulse for controlling writing current. The current driver 15 writes brightness data to each of the pixel circuits 11 through the data lines 14-1 to 14-m.

Figure 7:
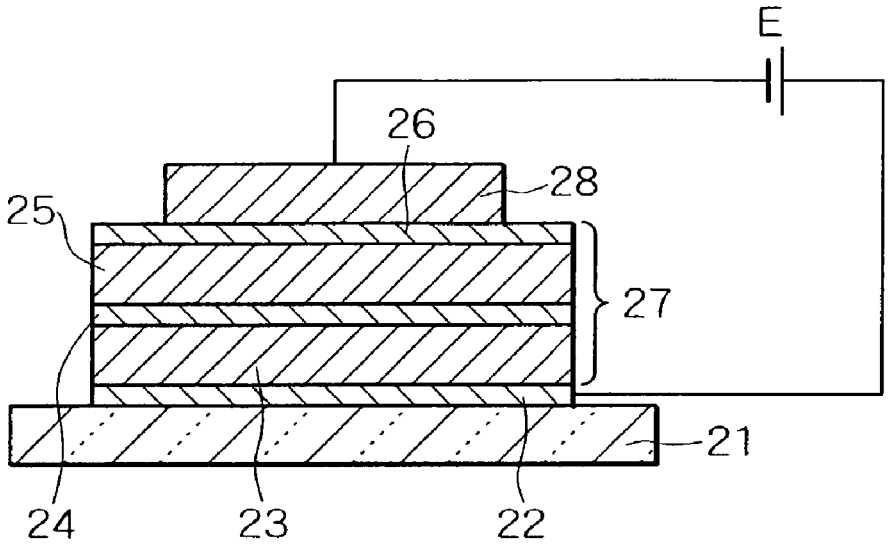
FIG. 7 is a sectional structure diagram showing an example of structure of an organic EL device.

An example of structure of an organic EL device will be described in the following. FIG. 7 shows a sectional structure of an organic EL device. As is clear from FIG. 7, the organic EL device is formed by creating a first electrode (for example anode electrode) 22 made of a transparent conductive film on a substrate 21 made of a transparent glass or the like, further creating an organic layer 27 on the first electrode 22 by depositing a hole carrying layer 23, a light emitting layer 24, an electron carrying layer 25, and an electron injection layer 26 in that order, and then forming a second electrode (for example cathode electrode) 28 made of a metal on the organic layer 27. By applying a direct-current voltage E between the first electrode 22 and the second electrode 28, light is emitted when an electron and a hole are recombined with each other in the light emitting layer 24.

In the thus formed active matrix type display apparatus, the current writing type pixel circuits 11 are formed using field-effect transistors (polysilicon TFTs in this case). Therefore, when the current driver 15 is to be mounted on the same substrate as that of the pixel portion, it is desirable to form the current driver 15 also using field-effect transistors. However, the current driver 15 may also be formed as a circuit external to the pixel portion. In this case, the current driver 15 may also be formed using bipolar transistors.

A few concrete examples of configuration of the current driver 15 will be described in the following.

First Concrete Example

Figure 8:
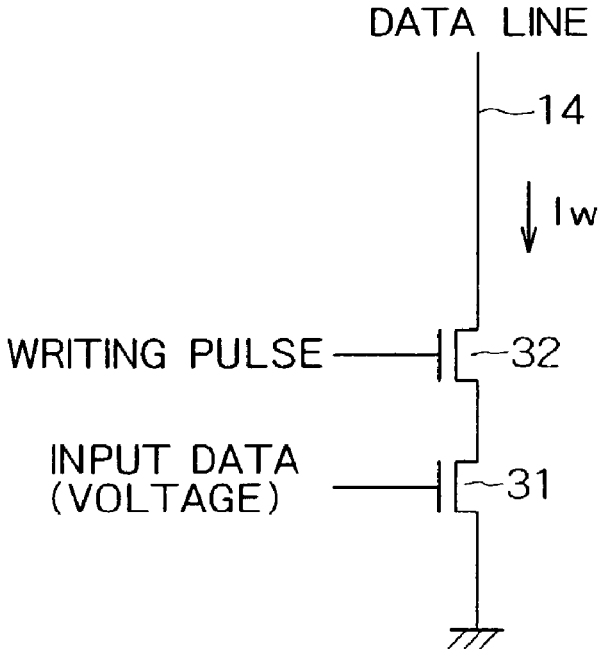
FIG. 8 is a circuit diagram showing a first concrete example of a data line driving circuit.

FIG. 8 is a circuit diagram showing a first concrete example of the current driver 15. A circuit according to the first concrete example is a unit circuit corresponding to one data line, and a set of such unit circuits corresponding in number with the n columns forms the current driver .

In FIG. 8, brightness data (input data) to be written to a pixel is supplied in the form of voltage to a gate of an N-channel TFT 31, for example, having a source grounded. The TFT 31 functions to convert the brightness data voltage into a current to flow through a data line 14. In the present example, high brightness data voltage corresponds to great current, that is, writing current for high brightness.

Figure 9:
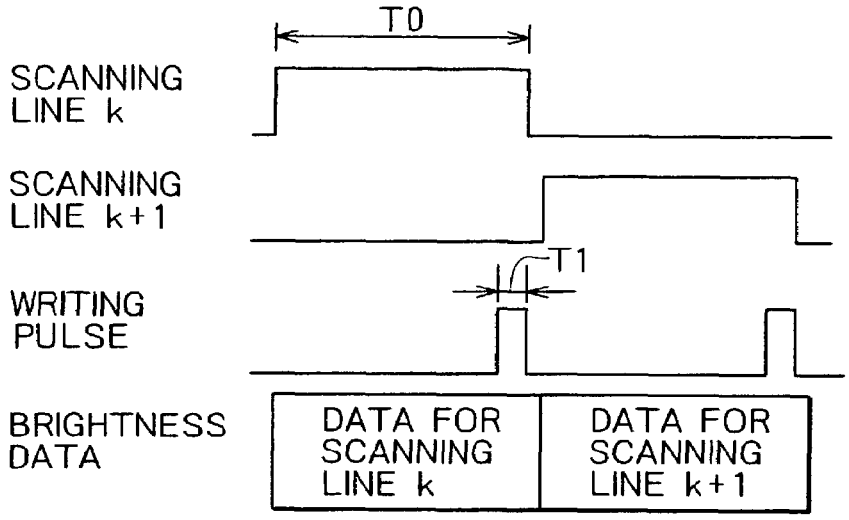
FIG. 9 is a timing chart of the first concrete example.

An N-channel TFT 32, for example, is inserted as a writing switch between a drain of the TFT 31 and one end of the data line 14. A gate of the TFT 32 is supplied with a writing pulse. As shown in a timing chart of FIG. 9, the writing pulse exhibits a high level only around an end of a brightness data writing cycle, that is, a scanning cycle. The writing pulse is commonly supplied to the gates of the TFTs 32 disposed one for each of the columns.

By applying the writing pulse to the gate of the TFT 32, the TFT 32 is brought into an on state only during a short period around the end of the scanning cycle, during which period the brightness data is written to the pixel. On the other hand, during most of the scanning cycle, during which the writing pulse is at a low level, the brightness data is not written and no writing current flows through the data line 14. Thus, the TFT 32 functions as a current limiting device for limiting the writing current flowing through the data line 14.

Thus, in the circuit configuration according to the first concrete example, the brightness data is written only during the short period around the end of the scanning cycle. It is therefore clear that letting T1 be a period within one scanning cycle during which period the writing pulse is at a high level, and T0 be one scanning cycle period, direct-current power consumption by the writing current is reduced to substantially T1/T0, as against the conventional examples that perform writing throughout one scanning cycle period T0.

The reduction of the writing time for lower power consumption may cause a problem in writing low-brightness data, as described in the section "Problems to be Solved by the Invention." Hence, there is a limit to the reduction of the writing time, and consequently the effect of reducing power consumption will be limited. A second concrete example, which will be described in the following, is provided as a measure against this problem.

Second Concrete Example

Figure 10:
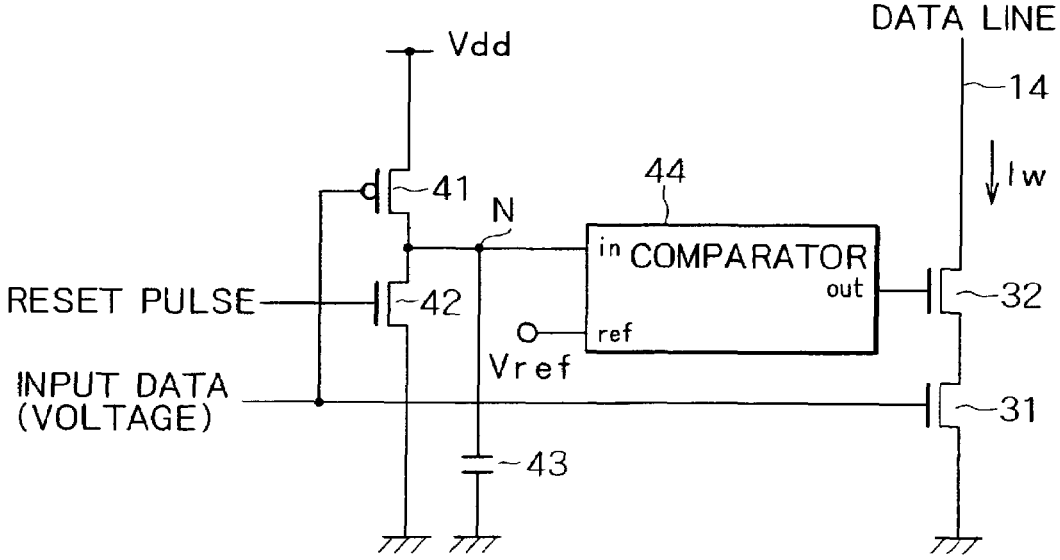
FIG. 10 is a circuit diagram showing a second concrete example of the data line driving circuit.

FIG. 10 is a circuit diagram showing a second concrete example of the current driver 15. The second concrete example is configured to effect control so as to lengthen writing time at the time of low brightness and shorten writing time at the time of high brightness. A circuit according to the second concrete example is also a unit circuit corresponding to one data line, and a set of such unit circuits corresponding in number with the n columns forms the current driver In FIG. 10, a P-channel TFT 41 and an N-channel TFT 42 are connected in series with each other between a positive power supply Vdd and a ground. Input data is applied in the form of voltage to a gate of the TFT 41 as well as a gate of a TFT 31. A positive reset pulse is applied to a gate of the TFT 42. A capacitor 43 is connected between the ground and a node N to which drains of the TFTs 41 and 42 are commonly connected.

A voltage at the node N is given to a comparison input terminal in of a comparator 44. A reference voltage Vref is applied to a reference voltage input terminal ref of the comparator 44. The comparator 44 compares the comparison input voltage of the input terminal in with the reference voltage Vref. Only when the comparison input voltage is higher than the reference voltage Vref, the comparator 44 outputs a high-level signal from an output terminal out. The signal outputted by the comparator 44 is supplied to a gate of a TFT 32 serving as a writing switch.

The circuit operation of the thus formed second concrete example will next be described. First, prior to operation of writing brightness data, a positive reset pulse is supplied to the gate of the TFT 42. The potential of the node N is then reset to a low level. When an input data voltage is applied in this reset state, the TFT 41 is brought into a conducting state to thereby charge the capacitor 43. The potential of the node N is thereby increased gradually.

Then, when the potential of the node N exceeds the reference voltage Vref, the potential of the output terminal out of the comparator 44 is changed to a high level to thereby bring the TFT 32 serving as the writing switch into a conducting state. In this case, the higher the input data voltage, the lower the current flowing through the TFT 41; therefore, it takes time to charge the capacitor 43 and hence it takes time for the potential of the node N to exceed the reference voltage Vref. Thus, for high-brightness data, it takes time before the TFT 32 conducts, and accordingly the writing time is shortened. A total writing time can be adjusted by the voltage value of the reference voltage Vref.

Thus, with the circuit configuration according to the second concrete example, it is possible to ensure a long writing time at the time of low brightness and also reduce the writing time at the time of high brightness. It is consequently possible to reduce power consumption required to write brightness data.

Third Concrete Example

Figure 11:
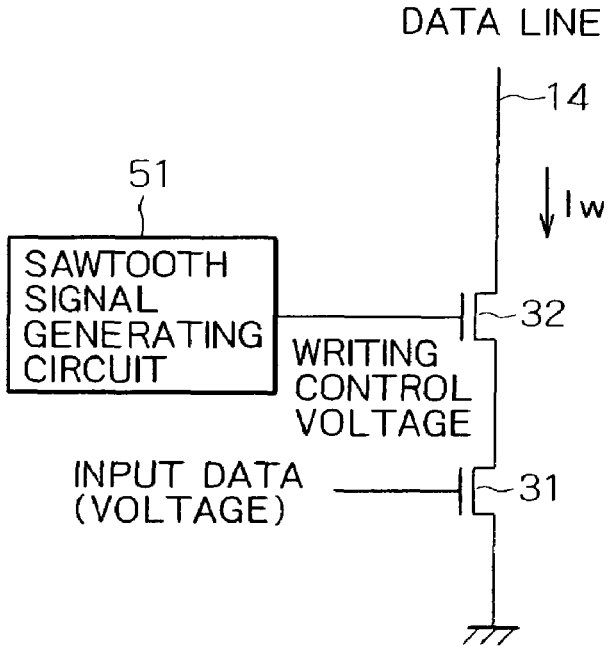
FIG. 11 is a circuit diagram showing a third concrete example of the data line driving circuit.

FIG. 11 is a circuit diagram showing a third concrete example of the current driver 15. A circuit according to the third concrete example is also a unit circuit corresponding to one data line, and a set of such unit circuits corresponding in number with the n columns forms the current driver .

Figure 12:
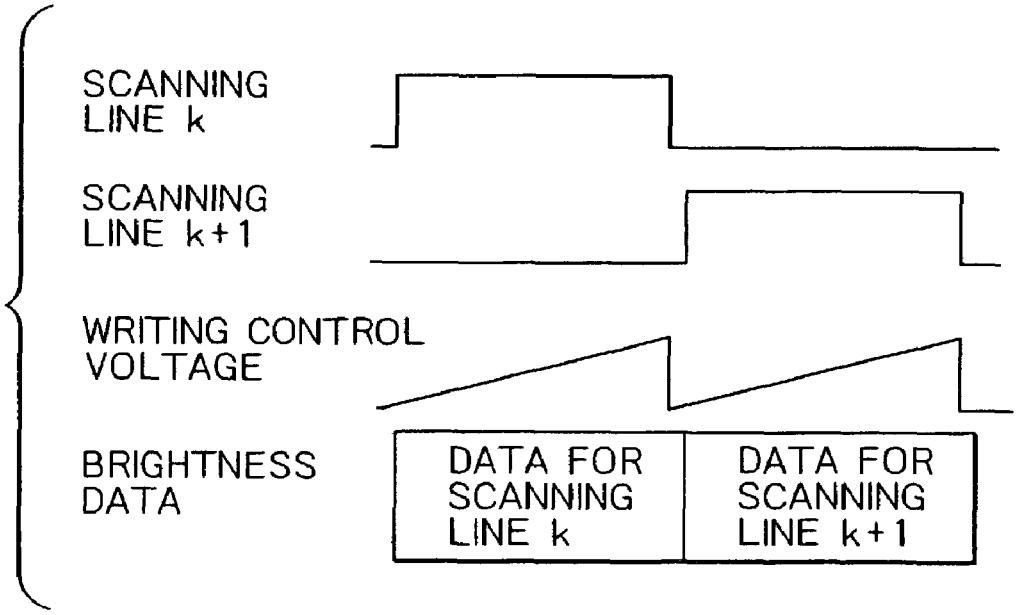
FIG. 12 is a timing chart of the third concrete example.

As is clear from FIG. 11, the circuit according to the third concrete example is provided with a sawtooth signal generating circuit 51 for generating a signal that temporally increases gradually within a brightness data writing cycle, for example a sawtooth signal (see a timing chart of FIG. 12). The sawtooth signal generated by the sawtooth signal generating circuit 51 is supplied as a writing voltage to a gate of a TFT 32 serving as a writing switch (analog switch).

The circuit operation of the thus formed third concrete example will next be described with reference to the timing chart of FIG. 12.

Around the time of a start of writing, the TFT 32 has a low gate potential, and therefore cannot allow a flow of great current. Specifically, even when an input voltage of a TFT 31 is high (at the time of high-brightness data), the TFT 32 has a high impedance and thus causes a great voltage drop. Thus, a drain potential of the TFT 31 is lowered, so that the TFT 31 cannot operate in a saturation region and allows only a low driving current to flow. That is, a writing current Iw is limited by the TFT 32.

When the input data voltage of the TFT 31 is low (at the time of low-brightness data), on the other hand, a low current flows through the TFT 31 and the TFT 32, and therefore the TFT 32 causes a small voltage drop. As a result, the TFT 31 has a low gate voltage and a relatively high drain voltage, so that the TFT 31 easily operates in a saturation region, or operates as a constant-current source. In this case, the TFT 32 imposes no limitation on writing operation, and therefore the writing operation is performed properly. Around the time of an end of the writing, the TFT 32 has a high gate potential and hence a low impedance, so that the writing operation even for high-brightness data is performed properly.

Consequently, the circuit according to the third concrete example in effect lengthens the writing time for low-brightness data and shortens the writing time for high-brightness data. It is thus possible to lower current consumption involved in writing while realizing proper writing operation. Also, in addition to the same effects as those of the circuit according to the second concrete example, the circuit according to the third concrete example eliminates the need for the comparator 44 and its peripheral circuit required to be provided in the circuit according to the second concrete example for each data line 14. The circuit according to the third concrete example therefore has an advantage of correspondingly simplifying the configuration of the circuit.

It is to be noted that while the third concrete example is configured to linearly change the gate potential of the TFT 32 serving as the writing switch, when it is difficult to effect such continuous control accurately, the third concrete example may be configured to effect stepwise control. It is essential that the third concrete example be configured to temporally increase the gate potential of the TFT 32 gradually within a brightness data writing cycle.

Fourth Concrete Example

Figure 13:
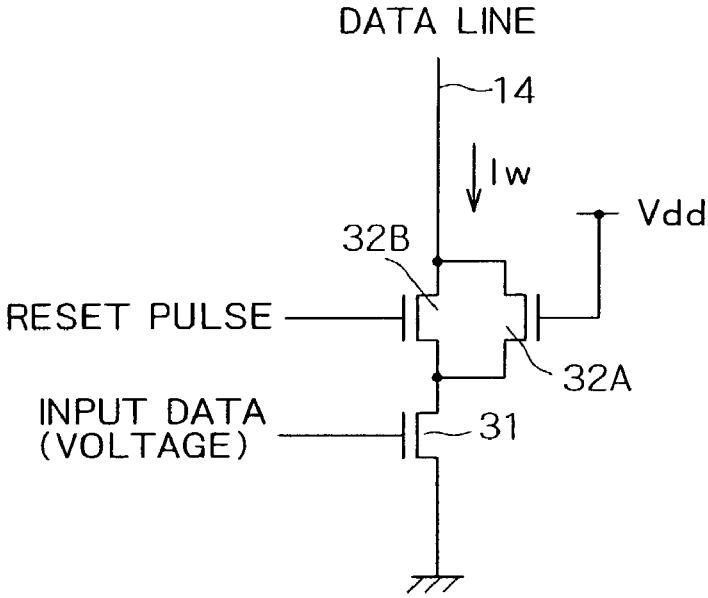
FIG. 13 is a circuit diagram showing a fourth concrete example of the data line driving circuit.

FIG. 13 is a circuit diagram showing a fourth concrete example of the current driver 15. A circuit according to the fourth concrete example is also a unit circuit corresponding to one data line, and a set of such unit circuits corresponding in number with the n columns forms the current driver .

The circuit according to the fourth concrete example has a plurality of TFTs having different current driving capabilities from each other, or a TFT 32A having a low current driving capability and a TFT 32B having a high current driving capability in this case, connected in parallel with each other as a writing switch. A positive power supply voltage Vdd is applied to a gate of the TFT 32A. A writing pulse exhibiting a high level only around an end of writing time of a scanning cycle is applied to a gate of the TFT 32B.

The current driving capability can be determined by setting channel width and channel length of the transistor. As an example of relation in the level of current driving capability between a TFT 31, the TFT 32A, and the TFT 32B, the current driving capability of the TFT 32B is set equal to or higher than that of the TFT 31, and the current driving capability of the TFT 32A is set lower than that of the TFT 32B.

Figure 14:
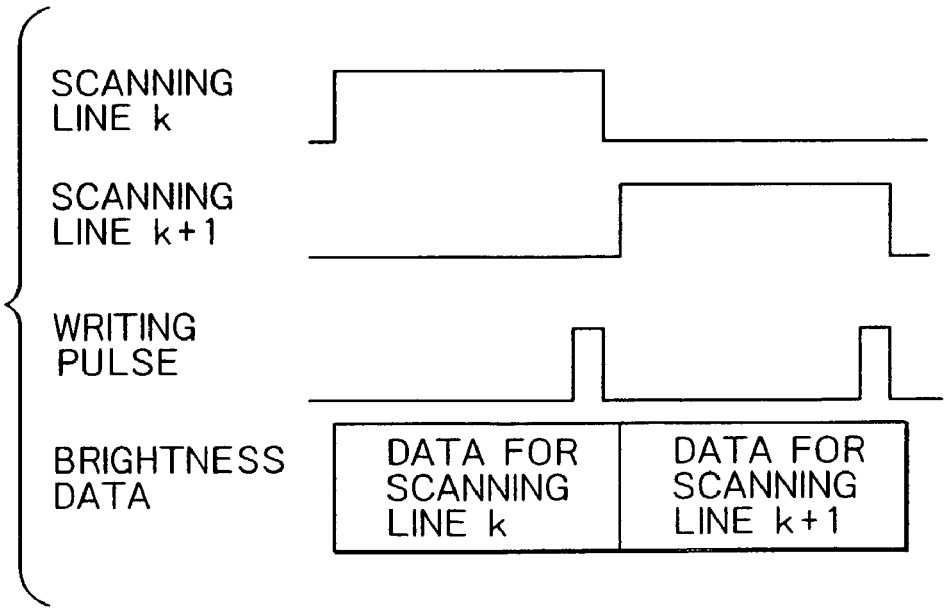
FIG. 14 is a timing chart of the fourth concrete example.

The circuit operation of the thus formed fourth concrete example will next be described with reference to a timing chart of FIG. 14.

Since the gate of the TFT 32A having a low current driving capability is biased by the power supply voltage Vdd, the TFT 32A is in a conducting state at all times. By applying a writing pulse to the gate of the TFT 32B having a high current driving capability, the TFT 32B is brought into a conducting state only around an end of a writing time. The TFT 32A limits a writing current Iw while the TFT 32B is not conducting, whereby power consumption is reduced, and at the same time, low-brightness data (low current) is driven properly through the TFT 32A.

Consequently, the circuit according to the fourth concrete example in effect lengthens the writing time for low-brightness data and shortens the writing time for high-brightness data. It is thus possible to lower current consumption involved in writing while realizing proper writing operation.

It is to be noted that while the fourth concrete example has been described by taking as an example a case where two TFTS, or the TFT 32A having a low current driving capability and the TFT 32B having a high current driving capability, are connected in parallel with each other as a writing switch for two-step control of the writing current Iw. The fourth concrete example is not limited to the two steps; three or more transistors having different current driving capabilities may be connected in parallel with each other for still finer stepwise control of the current. In addition, the current driving capabilities of the plurality of transistors connected in parallel with each other do not necessarily need to be of different values from each other; depending on a range of a current region to be controlled, a combination of transistors including transistors having current driving capabilities at the same level may be used.

The foregoing embodiments have been described by taking as an example a case where an organic EL device is used as a display device of a pixel, and a polysilicon thin film transistor is used as an active device of the pixel so that the present invention is applied to an active matrix type organic EL display apparatus obtained by forming the organic EL device on a substrate where the polysilicon thin film transistor is formed. However, the present invention is not limited to this; the present invention is applicable to active matrix type display apparatus in general use, as a display device of a pixel, a current-controlled type electrooptic device that varies brightness according to a current flowing therein.

As described above, the present invention limits the writing current to a low level (or zero) in an early stage of a writing cycle, and thereby reduces the average value of the writing current. It is therefore possible to lower power consumption.

While the preferred embodiments of the present invention have been described using the specific terms, such description is for illustrative purposes only, and it is to be understood that changes and variations may be made without departing from the spirit or scope of the following claims.

What is claimed is:

1. An active matrix type display apparatus comprising:

a pixel unit formed by arranging pixel circuits in a matrix manner, said pixel circuits each having an electrooptic device that changes brightness thereof according to a current flowing therein and driving said electrooptic device on the basis of brightness data supplied as current via a data line; and a current driving circuit for supplying each of said pixel circuits via said data line with a writing current that temporally increases in magnitude of a current value thereof within a cycle of writing said brightness data, said writing current having a first current value corresponding to a low brightness data in a beginning portion of the writing cycle and having a second current value corresponding to a high brightness data in a terminating portion of the writing cycle, the high brightness data corresponding to a higher emitted brightness than the low brightness data, wherein said current driving circuit has a current limiting device connected in series with said data line, and temporally increases the current value limited by the current limiting device within said writing cycle, and wherein said current limiting device is formed by a field-effect transistor, and said limited current value is controlled by a gate voltage of the field-effect transistor.

2. An active matrix type display apparatus as claimed in claim 1, wherein:

said current driving circuit limits the writing current to a low level in an early stage of the writing cycle, and begins to pass said writing current of the current value corresponding to the high brightness data at an intermediate point within said writing cycle.

3. An active matrix type display apparatus as claimed in claim 1, wherein:

said current driving circuit passes said writing current corresponding to low-brightness data in early timing of said writing cycle and passes writing current corresponding to high-brightness data in late timing of said writing cycle.

4. An active matrix type display apparatus as claimed in claim 1, wherein:

said current limiting device is formed by a plurality of current limiting devices connected in parallel with each other, and the plurality of current limiting devices are sequentially brought into a conducting state at a time interval within said writing cycle.

5. An active matrix type display apparatus as claimed in claim 4, wherein:

at least one of said plurality of current limiting devices has a current driving capability different from the current driving capability of the other current limiting devices.

6. A driving method of an active matrix type display apparatus, said active matrix type display apparatus being formed by arranging pixel circuits in a matrix manner, said pixel circuits each having an electrooptic device that changes brightness thereof according to a current flowing therein and driving said electrooptic device on the basis of brightness data supplied as current via a data line, said driving method comprising:

supplying each of said pixel circuits via said data line with a writing current that temporally increases in magnitude of a current value thereof within a cycle of writing said brightness data, said writing current having a first current value corresponding to a low brightness data in a beginning portion of the writing cycle and having a second current value corresponding to a high brightness data in a terminating portion of the writing cycle, the high brightness data corresponding to a higher emitted brightness than the low brightness data, wherein said current driving circuit has a current limiting device connected in series with said data line, and temporally increases the current value limited by the current limiting device within said writing cycle, and wherein said current limiting device is formed by a field-effect transistor, and said limited current value is controlled by a gate voltage of the field-effect transistor.

7. An active matrix type organic electroluminescence display apparatus comprising:

a pixel unit formed by arranging pixel circuits in a matrix manner, said pixel circuits each using, as a display device, an organic electroluminescence device having a first electrode, a second electrode, and an organic layer including a light emitting layer between the first electrode and the second electrode, and driving said organic electroluminescence device on the basis of brightness data supplied as current via a data line; and a current driving circuit for supplying each of said pixel circuits via said data line with a writing current that temporally increases in magnitude of a current value thereof within a cycle of writing said brightness data, said writing current having a first current value corresponding to a low brightness data in a beginning portion of the writing cycle and having a second current value corresponding to a high brightness data in a terminating portion of the writing cycle, the high brightness data corresponding to a higher emitted brightness than the low brightness data, wherein said current driving circuit has a current limiting device connected in series with said data line, and temporally increases the current value limited by the current limiting device within said writing cycle, and wherein said current limiting device is formed by a field-effect transistor, and said limited current value is controlled by a gate voltage of the field-effect transistor.

8. An active matrix type organic electroluminescence display apparatus as claimed in claim 7, wherein:

said current driving circuit limits the writing current to a low level in an early stage of the writing cycle, and begins to pass said writing current of the current value corresponding to the high brightness data at an intermediate point within said writing cycle.

9. An active matrix type organic electroluminescence display apparatus as claimed in claim 7, characterized in that:

said current driving circuit passes said writing current corresponding to low-brightness data in early timing of said writing cycle and passes writing current corresponding to high-brightness data in late timing of said writing cycle.

10. An active matrix type organic electroluminescence display apparatus as claimed in claim 7, wherein:

said current limiting device is formed by a plurality of current limiting devices connected in parallel with each other, and the plurality of current limiting devices are sequentially brought into a conducting state at a time interval within said writing cycle.

11. An active matrix type organic electroluminescence display apparatus as claimed in claim 10, wherein:

at least one of said plurality of current limiting devices has a current driving capability different from the current driving capability of the other current limiting devices.

12. A driving method of an active matrix type organic electroluminescence display apparatus, said active matrix type organic electroluminescence display apparatus being formed by arranging pixel circuits in a matrix manner, said pixel circuits each using, as a display device, an organic electroluminescence device having a first electrode, a second electrode, and an organic layer including a light emitting layer between the first electrode and the second electrode, and driving said organic electroluminescence device on the basis of brightness data supplied as current via a data line, said driving method comprising:

supplying each of said pixel circuits via said data line with a writing current that temporally increases in magnitude of a current value thereof within a cycle of writing said brightness data, said writing current having a first current value corresponding to a low brightness data in a beginning portion of the writing cycle and having a second current value corresponding to a high brightness data in a terminating portion of the writing cycle, the high brightness data corresponding to a higher emitted brightness than the low brightness data, wherein said current driving circuit has a current limiting device connected in series with said data line, and temporally increases the current value limited by the current limiting device within said writing cycle, and wherein said current limiting device is formed by a field-effect transistor, and said limited current value is controlled by a gate voltage of the field-effect transistor.

* * * * *